US011827260B2

(12) United States Patent
Corbo et al.

(10) Patent No.: US 11,827,260 B2
(45) Date of Patent: Nov. 28, 2023

(54) GRADE CROSSING CONTROL SYSTEM

(71) Applicant: Siemens Mobility, Inc., New York, NY (US)

(72) Inventors: Mark Corbo, Prospect, KY (US); Richard Bamfield, Upper Moutere (NZ)

(73) Assignee: Siemens Mobility, Inc., New York, NY (US)

( * ) Notice: Subject to any disclaimer, the term of this patent is extended or adjusted under 35 U.S.C. 154(b) by 715 days.

(21) Appl. No.: 16/964,662

(22) PCT Filed: Mar. 6, 2018

(86) PCT No.: PCT/US2018/021063
§ 371 (c)(1),
(2) Date: Jul. 24, 2020

(87) PCT Pub. No.: WO2019/172885
PCT Pub. Date: Sep. 12, 2019

(65) Prior Publication Data

US 2021/0053598 A1 Feb. 25, 2021

(51) Int. Cl.
*B61L 29/22* (2006.01)
*B61L 1/18* (2006.01)
(Continued)

(52) U.S. Cl.
CPC ..... *B61L 29/226* (2013.01); *B61L 1/187* (2013.01); *B61L 1/188* (2013.01); *B61L 29/30* (2013.01); *B61L 29/32* (2013.01)

(58) Field of Classification Search
CPC ..... B61L 1/187; B61L 1/188; B61L 29/226; B61L 29/30; B61L 29/32
See application file for complete search history.

(56) References Cited

U.S. PATENT DOCUMENTS 3,660,652 A 5/1972 Staples et al.
3,838,271 A * 9/1974 Ackard ..... B61L 29/286 246/28 F
(Continued)

FOREIGN PATENT DOCUMENTS

EP 0002609 A1 6/1979
EP 2371666 A2 10/2011
(Continued)

OTHER PUBLICATIONS

Gerhard Grundnig et al., "Wheel detection and axle counting as key elements of level crossing protection systems", Signal + Draht, DVV, vol. 105, No. 12, Dec. 1, 2013, pp. 30-35.
(Continued)

*Primary Examiner* — Robert J McCarry, Jr.

(57) ABSTRACT

A grade crossing control system includes a controller that receives start and end inputs corresponding to a train traversing an outer approach, determines the difference in time between the start and end inputs, and uses the difference in time to determine a delay period by which activation of a grade crossing warning system will be delayed following detection of the train by a track occupancy circuit in an inner approach in order to compensate for slow moving trains. The start and end inputs for the outer approach may be supplied in different ways including a separate track occupancy circuit for the outer approach, by train detection devices unconnected to the track at the start and end of the outer approach, or by overlapping track occupancy circuits positioned at the start of the outer and inner approaches.

17 Claims, 7 Drawing Sheets

(51) Int. Cl.
*B61L 29/30* (2006.01)
*B61L 29/32* (2006.01)

(56) References Cited

U.S. PATENT DOCUMENTS

| | | | |
|---|---|---|---|
| 8,590,844 | B2 | 11/2013 | Hogan |
| 2007/0084974 | A1 | 4/2007 | Sharkey et al. |

FOREIGN PATENT DOCUMENTS

| | | | | |
|---|---|---|---|---|
| EP | 2505452 | A2 * | 10/2012 | ..... B61L 15/0027 |
| EP | 2505452 | A2 | 10/2012 | |
| EP | 3228521 | A1 * | 10/2017 | ..... B61L 23/14 |
| EP | 3228521 | A1 | 10/2017 | |
| JP | 3346499 | B2 | 11/2002 | |

OTHER PUBLICATIONS

Manfred Sommergruber et al., "Innovative Zugdetektion fur hochverfugbare und konomishce BUSA - Innovative tracking of trains for high-level crossing protection systems", Signalling + Datacommunication, vol. 109, No. 12, Dec. 11, 2017, pp. 13-21.
PCT International Search Report and Written Opinion of International Searching Authority dated Nov. 30, 2018 corresponding to PCT International Application No. PCT/US2018/021063 filed Mar. 6, 2018.

* cited by examiner

GRADE CROSSING CONTROL SYSTEM

FIELD

This disclosure is directed toward control systems and methods for a railway grade, or level, crossings.

BACKGROUND

A grade crossing, also referred to as a level crossing, is a location where a railroad tracks cross a road, sidewalk or other surface used by moving objects (cars, trucks, pedestrians, etc.) at the same grade, or level (i.e., no bridge or tunnel is involved). At such locations, a crossing warning device warns of the approach of a train at a crossing so that moving objects on the road or other surface can avoid being struck as a train on the tracks traverses the crossing. Crossing warning devices may include crossing gate arms (e.g., the familiar red and white striped wooden arms often found at highway grade crossings to warn motorists of an approaching train), crossing lights (such as the two red flashing lights often found at highway grade crossings alone or in conjunction with the crossing gate arms discussed above), and/or crossing bells or other audio alarm devices. These crossing warning devices are controlled by a grade crossing control system.

Some types of grade crossing control systems utilize a type of circuit known in the art as a constant warning time (CWT) circuit to control crossing warning devices. Other types of grade crossing control systems, particularly those used with electrified track in which one or both of the rails along which the train travels is used to carry return current which interferes with the operation of CWT circuits, utilize a track occupancy circuit to control the crossing warning devices at a grade crossing. As discussed in U.S. Pat. No. 8,590,844, the entire contents of which are hereby incorporated by reference, track occupancy circuits are used in the railroad industry to detect the presence of a train in a block of track. The block of track monitored by a track occupancy circuit is typically referred to as an "approach" in the context of a grade crossing, and there is typically an approach on either side of the crossing.

There are several types of track occupancy circuits known in the art. One type, sometimes referred to as an AC overlay track occupancy circuit, includes a transmitter and a receiver, with the transmitter configured to transmit an AC signal, typically in the range of audio frequency, through the track rails at one end of a block of track and the receiver connected to the rails at the other end of the block and configured to detect the signal. Other than the connection through the track rails, there is typically no connection between the transmitter and receiver for a block in such AC overlay track occupancy circuits. When a train is present in a block of track monitored by a track circuit, the train shunts, or shorts, the two rails, with the result that no signal is received at the receiver, and the loss of a signal from the transmitter at the receiver is taken as an indication that a train has entered the block of track. DC track circuits are also known in the art, although they are typically not used in electrified track grade crossing applications. Still other types of track occupancy circuits are known in the art.

In a grade crossing control system using a track circuit, the track circuit may be configured to an approach with a length chosen based in part on a maximum expected speed (e.g., a maximum allowed speed) of a train along that section of track. When an AC overlay track occupancy circuit is used, the receiver may be placed at or near the crossing (e.g., just outside of an edge of the island closest to the block), and the transmitter may be placed at the far end of the block. The grade crossing control system may be configured to activate the grade crossing warning device as soon as the track circuit detects the presence of a train and deactivate the grade crossing warning device after the train has passed the crossing. In such systems, a train moving more slowly than the maximum expected speed will result in an unnecessarily long period during which the grade crossing warning device is activated.

DETAILED DESCRIPTION

Figure 1:
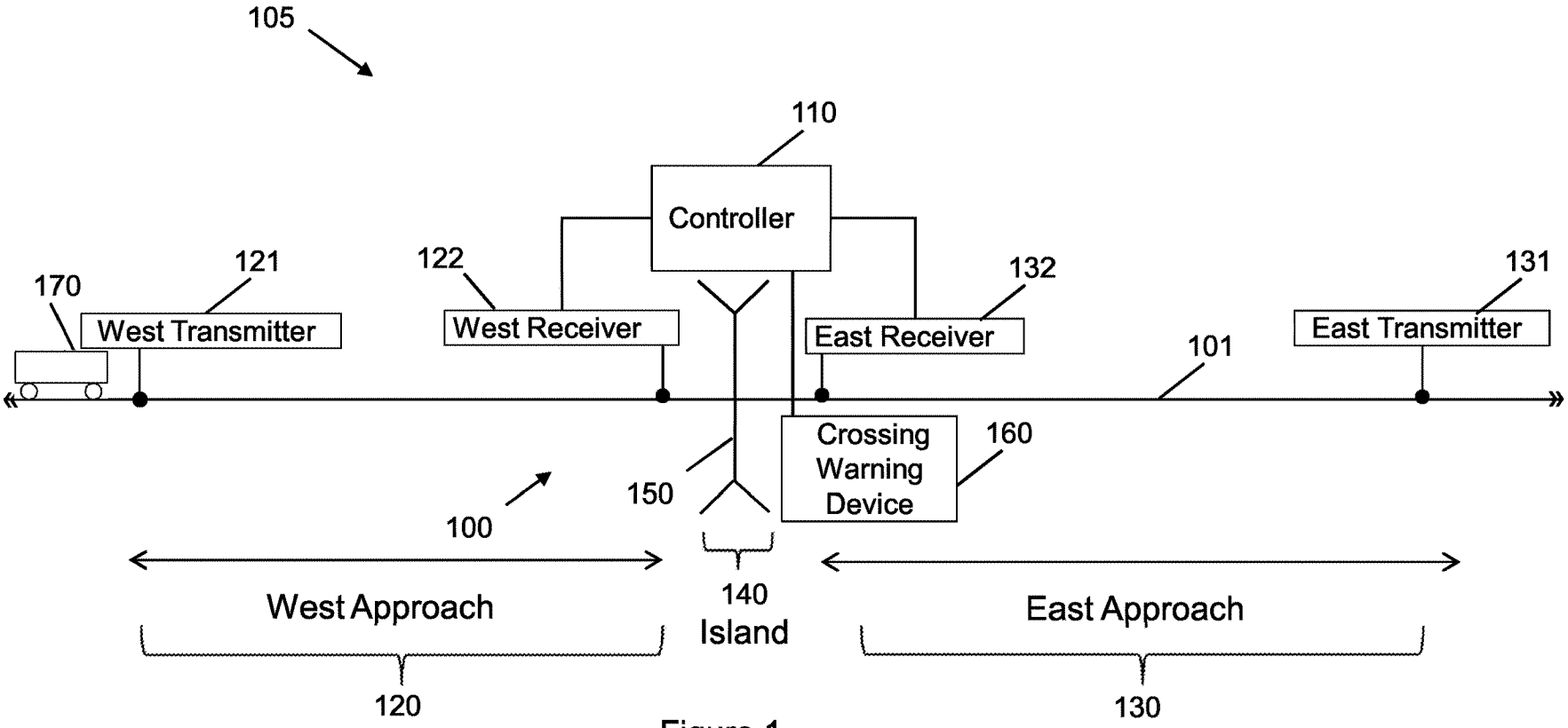
FIG. 1 is a plan diagram of a conventional grade crossing with a grade crossing control system.

A conventional grade crossing 105 with a grade crossing control system, i.e. controller, 110 is shown in FIG. 1. Bidirectional train travel is possible along the train track 101, but unidirectional installations are also known in the art. The grade crossing control system/controller 110 is connected to two AC overlay track circuit receivers 122, 132 which are positioned on either side of the island 140 to monitor respective sections of track labeled in FIG. 1 as West Approach and East Approach. The island 140 is a portion of the train track 101 approximately equal to the width of the road 150 at the crossing 100. AC overlay track circuit transmitters 121, 131, one for each of the receivers 122, 132 are positioned at an approach distance from their respective receivers 122, 132. The AC track overlay receivers 122, 132 and transmitters 121, 131, may be PSO 4000 devices available from Siemens Mobility, Inc. The approach distance (indicated by the West Approach and East Approach arrows in FIG. 1) is chosen based in part on an expected maximum train speed. The controller 110 is also connected to control a grade crossing warning device 160 configured and positioned to warn vehicles on the road 150 when a train is approaching or in the intersection 100. An island circuit (not shown in FIG. 1) is also installed at the island 140 and connected to the controller 110. An island circuit is a track occupancy circuit that detects the presence of a train in the island 140. Island circuits are desirable so that a crossing warning device (e.g., the crossing gates) can be deactivated to allow traffic to use the road 150 to cross the track 101 as soon as the train has cleared the section of track 101 that crosses the road 150.

When no train is present on the track 101, both AC track circuits 120, 130 (each formed by a pair of receivers and transmitters) are energized, indicating that no train is present. When a train 170 traveling along the track 101 reaches AC overlay the transmitter 121 at the start of the West Approach, the train's axles and wheels effectively short the circuit such that no signal or a significantly attenuated signal is received at the receiver 122 (this is referred to in the art as the track circuit 120 or the receiver 122 de-energizing, or dropping). When this occurs, the controller 110 activates the grade crossing warning device 160 (although the grade crossing warning device 160 is illustrated as a single box in FIG. 1, it should be understood that the single box may represent multiple devices, such as multiple crossing gates, one for each side of the roadway and one for each sidewalk, and/or multiple warning lights and/or electronically/electrically controlled visual indicators and/or multiple bells). The controller 110 continues to keep the grade crossing warning device 160 active while the train 170 is in the West Approach and in the island. When the train 170 has progressed far enough to cause the island circuit and to enter the East Approach such that the AC overlay track occupancy circuit 130 drops (it being understood that a train will almost always be of a length longer than the island), a stick timer is set for a period of time such as 10 minutes. The controller 110 is configured such that the stick timer overrides the track occupancy circuit 130 in the East Approach on the other side of the island when the end of the train 170 has cleared the island such that the island circuit is re-energized and the train is in the East Approach, so that the controller 110 deactivates the grade crossing warning device 160 to allow vehicles to cross over the tracks to traverse the intersection 100 even though the train 170 is still in East Approach. When the stick timer expires, the track occupancy circuit 130 is no longer overridden and the controller 110 will once again activate the grade crossing warning device 160 when a train 170 is present in the East Approach.

From the foregoing discussion, one of skill in the art will recognize that the amount of time that the grade crossing warning device 160 will remain activated will depend on the speed of the train 170. One of skill in the art will further recognize that if the train is traveling well below the maximum expected speed, the grade crossing warning device 160 will remain activated for an amount of time that is significantly longer than necessary because the length of Approach 1 is chosen based on an expected maximum speed of the train rather.

Figure 2:
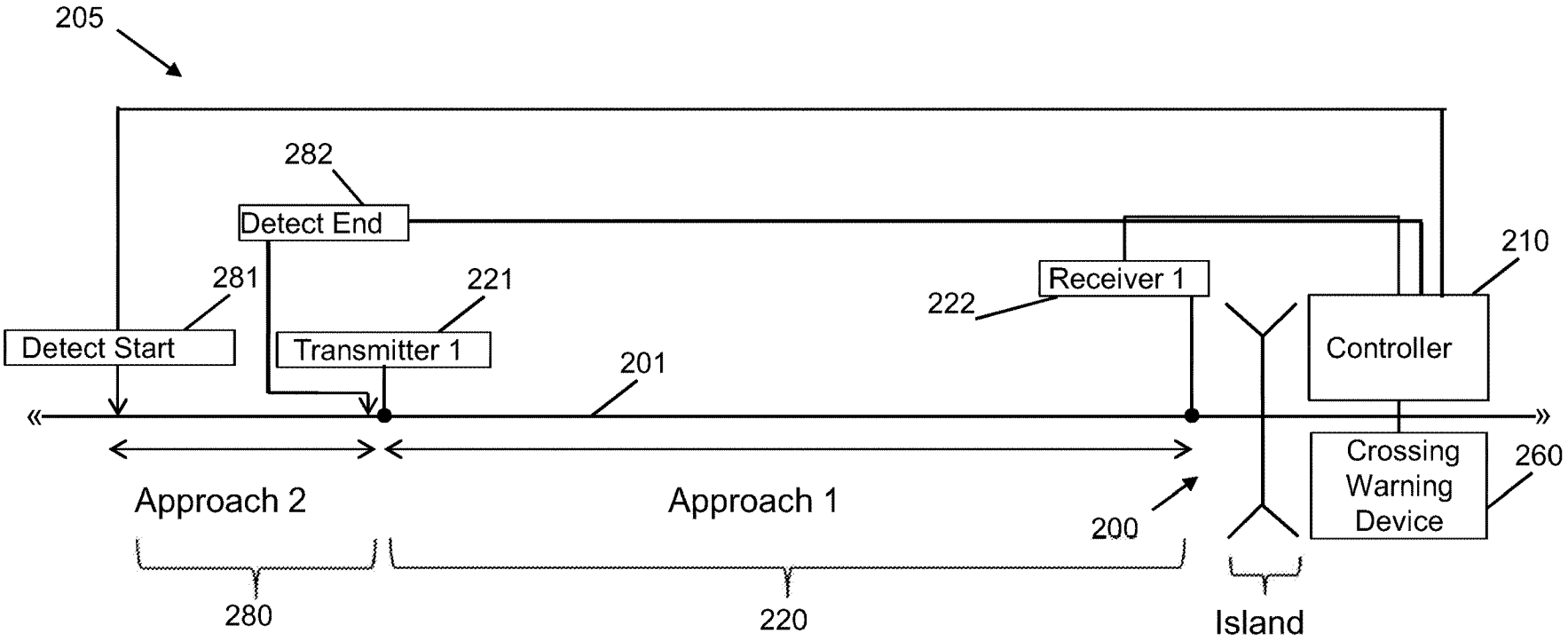
FIG. 2 is a plan diagram of a grade crossing with a grade crossing control system employing timed approach logic according to one embodiment.

FIG. 2 illustrates a grade crossing 200 with a grade crossing control system 205 that at least partially addresses this issue by employing timed approach logic. In FIG. 2, the left-hand side of a grade crossing 200 is illustrated, and it should be understood that equipment in the left-hand side of the crossing 200 may also be provided on the right-hand side of the crossing 200. In addition to a AC overlay track circuit receiver 222 that is in communication with a transmitter 221 to form an AC overlay track circuit 220 that monitors Approach 1 (an inner approach), and a grade crossing warning device 260, the grade crossing control system controller 210 is also connected to a device or circuit 280 including a first component 281 that provides a "start" input to the controller 210 when a train reaches the start of a section of track 201 labeled as Approach 2 (an outer approach) in FIG. 2 and a second component 282 that provides an "end" input when the train reaches the end of the Approach 2 section of track 201. The end of Approach 2 preferably, but not necessarily, corresponds to the start of Approach 1. As will be discussed in further detail below, this device 280 may be realized in many different ways, and the components 281 and 282 may or may not be connected to the track 201, and may communicate with the controller 210 directly or indirectly by a variety of means including one or more conductors that may be above or below ground, or via wireless communications. The controller 210 may measure the time it takes for the train to traverse the section of track 201 labeled as Approach 2 (the time between the start and end inputs, which depends on the speed of the train) and may determine a configurable delay period based on this time. If the train is traveling in an outbound direction with respect to the crossing 200 such that controller 210 receives the end input before the start input, the controller 210 may be configured to provide no configurable delay period.

The controller 210 may use the configurable delay period to delay activation of the crossing warning system 260 (referred to as "wrapping" or "bypassing" the track occupancy circuit) after train enters Approach 1 and the track occupancy circuit 220 drops. The delay period may be longer when time between the start and end inputs is long (indicating that the train speed is slow) and may be shorter or nonexistent when the time between the start and end inputs is short (indicating the train's speed is fast or at a maximum). In some embodiments, the delay period may take on a continuous range of values, and in other embodiments the delay period may take on one of a number of fixed values. The length of the section of track should be long enough to ensure that the time between the start and end inputs to the controller 210 accurately reflects the speed of the train and allows for adequate resolution among such fixed values. By delaying the activation of the crossing warning system 260 for a period of time that depends on the speed of the train, the amount of time wasted on unnecessarily long crossing warning system 260 activation periods may be reduced.

As discussed above, the device 280 that provides the start and end inputs to the controller 210 may be realized in many different ways. In one embodiment, a pair of detectors such as laser detectors, RFID tag readers, transponders, etc., may be placed at respective ends of the section of track 201. The detectors 281, 282 may communicate directly or indirectly (with one detector communicating through the other device, and/or one or both devices communicating through one or more additional devices) with the controller 210, and the communication may take place wholly or partly through one or more rails of the track 201, through one or more separate conductors such as a buried or above-round wire, optically, wirelessly or by any other means.

Figure 3:
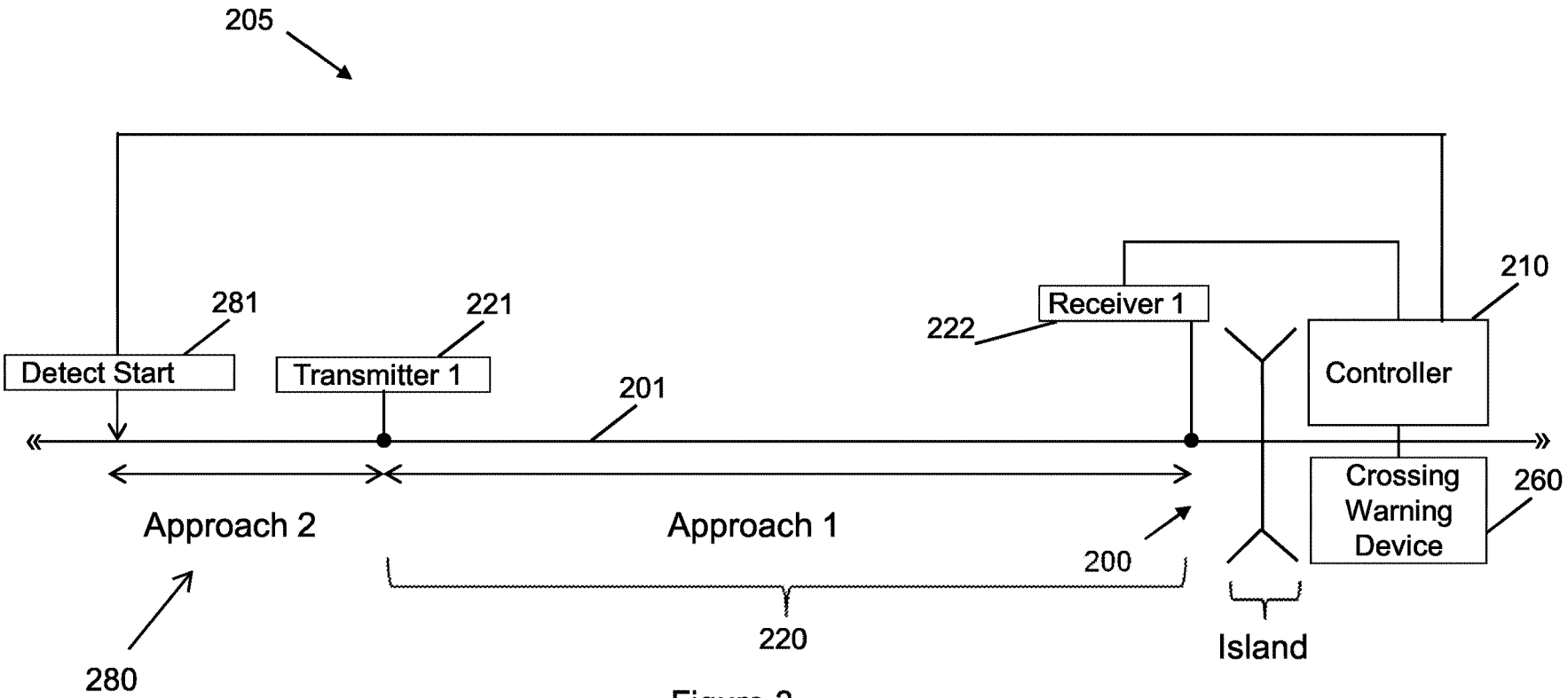
FIG. 3 is a plan diagram of a grade crossing with a grade crossing control system employing timed approach logic according to a second embodiment.

An embodiment of the device 280 is shown in FIG. 3. In this example, a component 281 may provide the start input to the controller 210, and the de-energization of the AC overlay track occupancy circuit 220 in Approach 1 formed by the transmitter 221 and the receiver 222 may be used as the end input to the controller 210. In this embodiment, activation of the crossing warning system 260 after the Approach 1 track occupancy circuit 220 drops, may be delayed (i.e., the track occupancy circuit 220 is wrapped) a short period on the order of 1-2 seconds to allow time for the timed approach logic of the controller 210 to calculate and apply the configurable delay based on the time between the start and end inputs.

Figure 4:
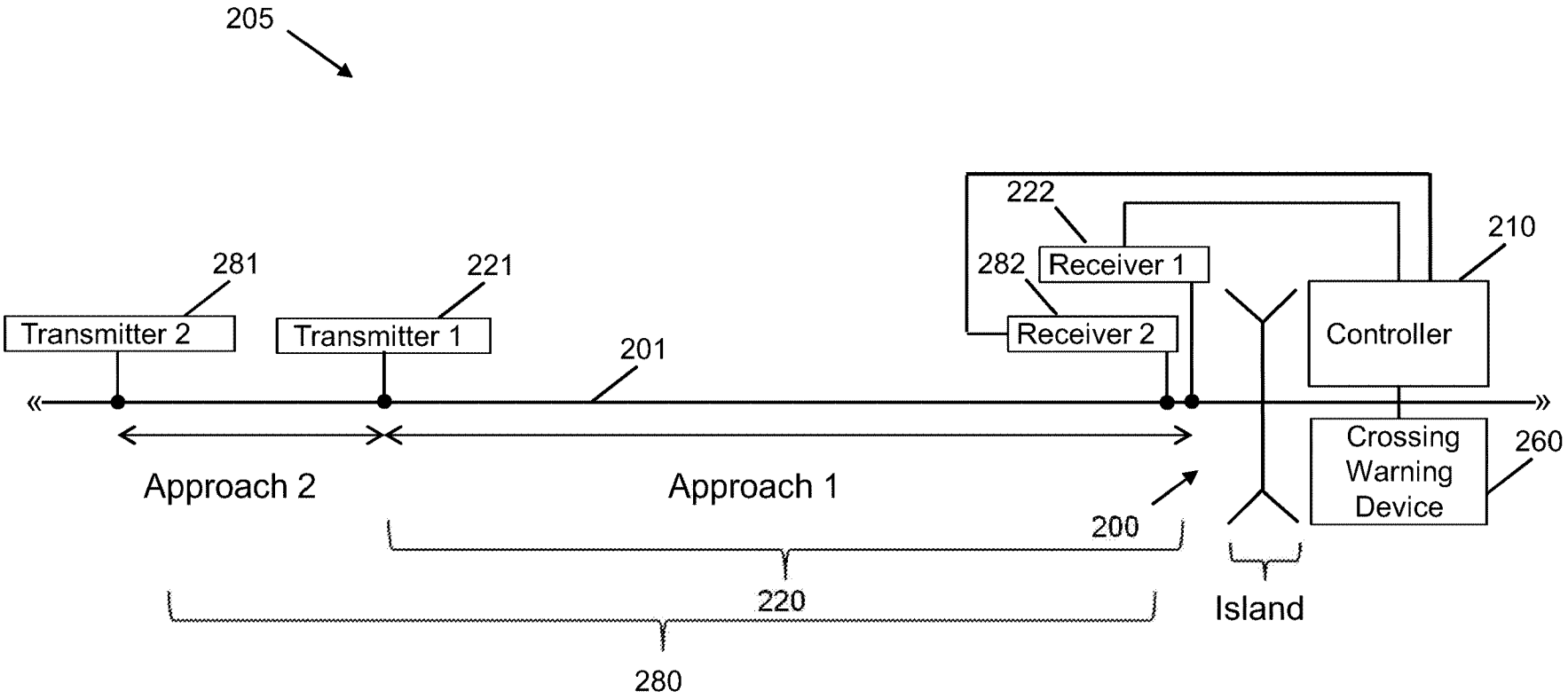
FIG. 4 is a plan diagram of a grade crossing with a grade crossing control system employing timed approach logic according to a third embodiment.

A fourth embodiment is shown in FIG. 4. In this embodiment, the device 280 may be comprised of a second track occupancy circuit including a second AC overlay transmitter 281 and a second AC overlay receiver 282. The second AC overlay transmitter may be positioned at the start of the section of track 280, and the second AC overlay receiver 282 may be co-located with the first AC overlay receiver 222 at the entrance to the island, with both receivers 222, 282 proving inputs to the controller 210. The second transmitter 281 and receiver 282 may be configured for a frequency different from the frequency of the first transmitter 221 and the first receiver 222. In this embodiment, the controller 210 may be configured to treat the de-energization of the second track circuit 280 as the start input, and the deenergization of the first track circuit 220 as the end input.

Figure 5:
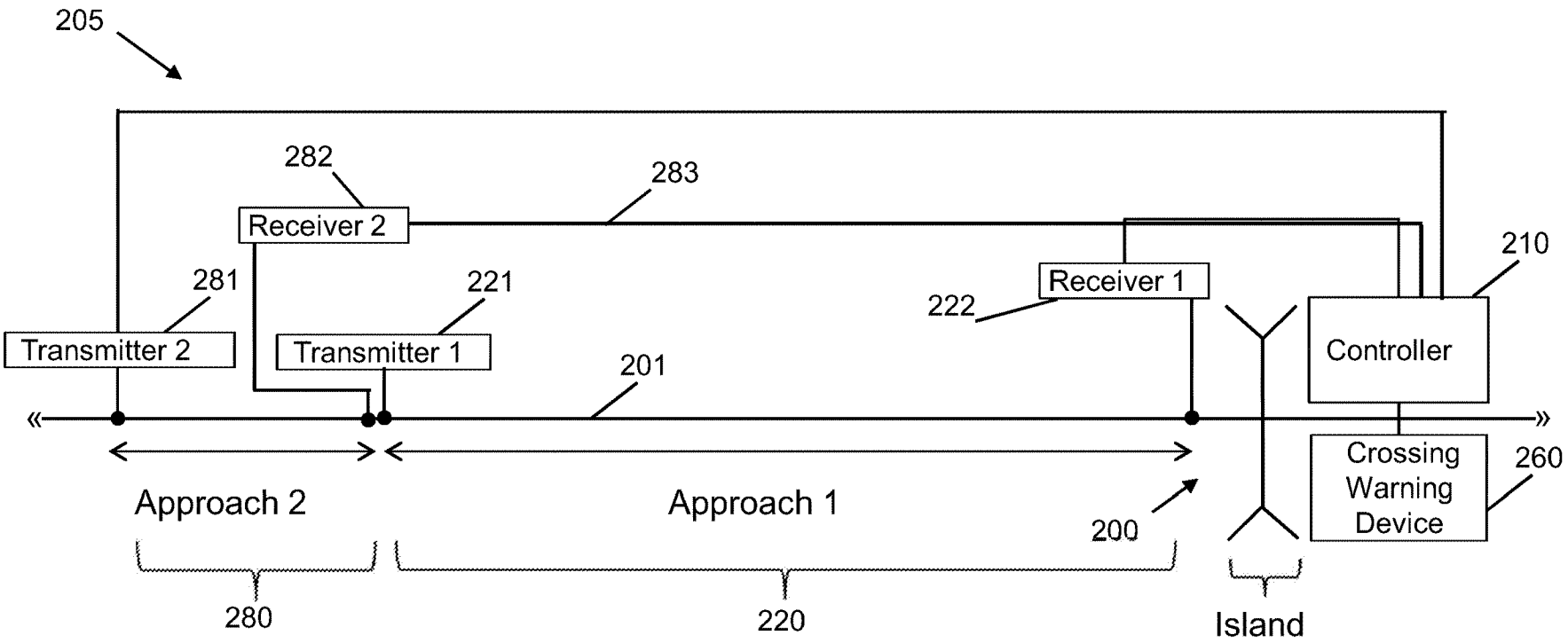
FIG. 5 is a plan diagram of a grade crossing with a grade crossing control system employing timed approach logic according to a fourth embodiment.

Another option, which may be utilized if different frequencies are not available for the two AC overlay track occupancy circuits 280, 220 of FIG. 4, is shown in FIG. 5. FIG. 5 is similar to FIG. 4, with the exception that the receiver 282 of the second track circuit 280 may be co-located with the first transmitter 221 rather than the first receiver 222. In this configuration, a separate wire 283 (which may be a buried wire or an above ground wire) from the second receiver 282 may provide the start input to the controller 210 (i.e., the drop of the second track occupancy circuit), while the first receiver 222 provides the end input to the controller 210 (i.e., the drop of the first track occupancy circuit). Alternatively, the separate wire 283 may be replaced by a wireless link in other embodiments.

Figure 6:
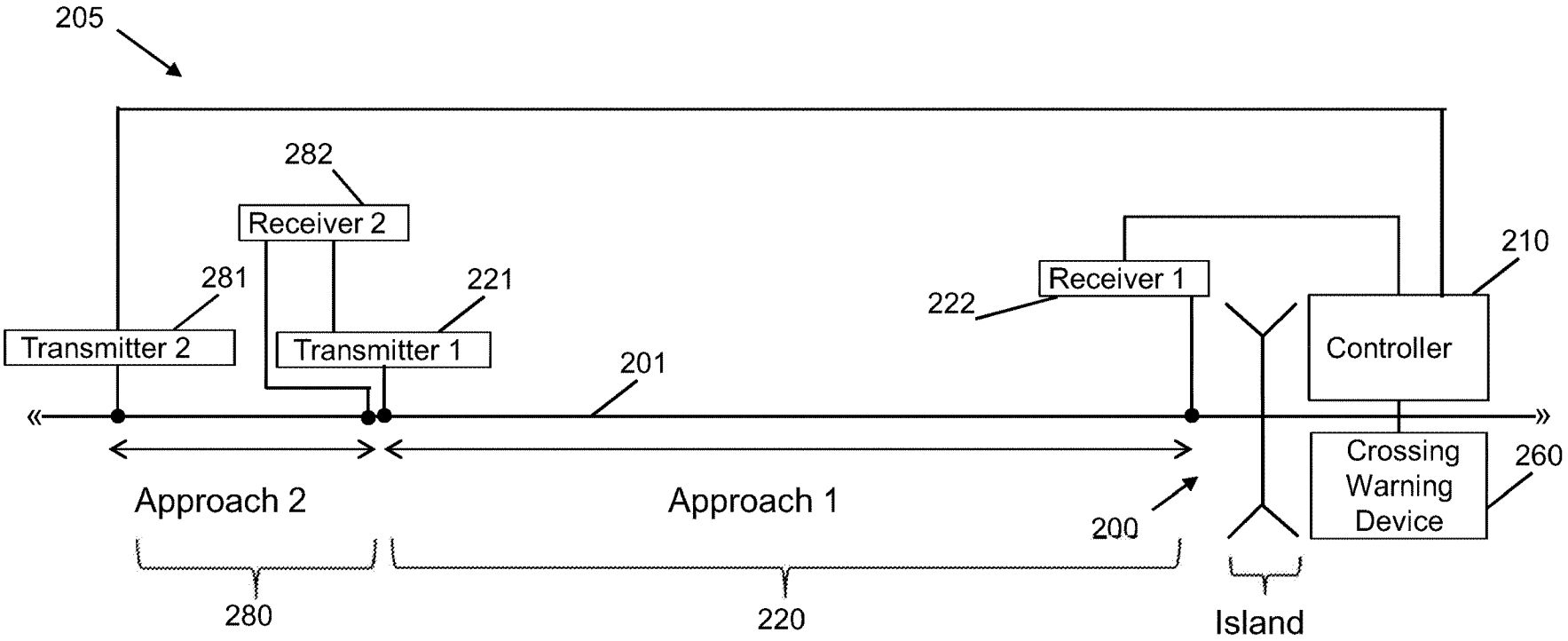
FIG. 6 is a plan diagram of a grade crossing with a grade crossing control system employing timed approach logic according to a fifth embodiment.

FIG. 6 illustrates an alternative to the use of the separate wire 283 in the embodiment of FIG. 5 to communicate the status of the second track occupancy circuit 280 to the controller 210. In the embodiment of FIG. 6, the receiver 282 of the second track occupancy circuit 280 may be in communication with the co-located transmitter 221 of the first track occupancy circuit 220 in Approach 1. Such an arrangement is described the aforementioned U.S. Pat. No. 8,590,844. The transmitter 221 may be configured to transmit a first code (e.g., code A) through the track 201 when the receiver 282 of the second track occupancy circuit indicates to the transmitter 221 that the receiver 282 does not detect the presence of a train, and to transmit a second code (e.g., code C) through the track 201 when the receiver 282 indicates that it does detect the presence of a train. This coded signal from the transmitter 221 may be received by the receiver 222 of the first track occupancy circuit 220, and the receiver 222 may communicate to the controller 210 whether the signal from the transmitter 221 has been received, which indicates that a train is not present in Approach 1, and whether the signal from the transmitter 221 is a code A or C, which indicates whether or not a train has been detected in Approach 2.

In operation, prior to the presence of any train in Approach 2, the receiver 282 of the second track occupancy circuit 280 may communicate the absence of a train in Approach 2 to the transmitter 221 of the first track occupancy circuit 220. In response, the transmitter 221 may transmit code A to the receiver 221 of the first track occupancy circuit 221, and the code A information is communicated to the controller 210 which interprets the code A information as indicating that no train is present in either Approach 1 or Approach 2. Once an eastbound train enters Approach 2, the signal transmitted by the transmitter 281 of the second track occupancy circuit in Approach 2 is no longer received by the receiver 282 of the second track occupancy circuit, which causes the receiver 282 to communicate the presence of a train in Approach 2 to the transmitter 221 of the first track occupancy circuit 220. In response to the indication of a detected train in Approach 2 from the receiver 282, the transmitter 221 of the first track occupancy circuit begins transmitted code C rather than code A. The receiver 222 of the first track occupancy circuit communicates the change from code A to code C to the controller 210. Controller 210 interprets the change from code A to code C as an indication that a train has entered Approach 2 but (because a code from the transmitter 221 is still being received by the receiver 222) has not yet entered Approach 1, and uses this as the start time input that is used together with an end time input as an indication of train speed as explained further below.

The transmission and receipt of code A will continue until such time as the train reaches Approach 1, at which point the receiver 222 of the first track occupancy circuit will no longer receive any signal from the transmitter 221 and will communicate this loss of signal to the controller 210. The controller 210 interprets the loss of signal as an indication that the train in Approach 2 has reached Approach 1, and will use this as the end time input. The controller 210 uses the difference between start and end times as an indication of train speed as discussed in further detail below.

In the embodiments discussed above in FIGS. 2-6, the controller 210 may receive a start input indicating that a train has reached the start of Approach 2, and an end input indicating that the train has reached the end of Approach 2. The difference between these times is inversely proportional to the train's speed. This difference may be used to calculate a speed of the train. For example, if constant velocity in Approach 2 is assumed, the speed of the train may be calculated as the difference in time between the start and end inputs divided by the length of Approach 2. Given the speed of the train, the time necessary for the train to traverse the length of Approach 1 can be calculated by dividing the length of Approach 1 by the speed. The resulting time may then be used to determine a delay period by which the track occupancy circuit 220 is wrapped.

However, the length of Approach 2 is constant, and therefore the calculation of the train speed is not necessary, and the controller may simply calculate the difference in time between the start and end inputs and use that difference as an indication of train speed. The delay period may include a safety factor, and may be subject to a maximum and/or a minimum delay which may be chosen depending on specifics of conditions at the actual crossing. The delay period may vary continuously between a minimum and maximum delay period depending on a mathematical formula, or may be one of a number of discrete values determined using a look-up table with the difference between the start and end inputs (which may be rounded or rounded up to the nearest integer value) serving as an index into the table, or may be determined by comparing the difference between the start and end inputs to thresholds associated with discrete delay periods.

Table 1 below illustrates exemplary parameters for one possible application employing thresholds as described above, and used with an installation such as that shown in FIG. 6 with track occupancy circuits identical to the left-hand side track occupancy circuits 220 and 280 on the left-hand side of the crossing 200 also present and connected to communicate with the controller 210 in the same manner such that approaches identical to Approach 1 and Approach 2 on the left-hand side of the crossing 200 are also present on the right-hand side. In this installation, the length of Approach 1 (the inner approach) on either side of the crossing may be 6000 feet, and the length of Approach 2 (the outer approach) on either side of the crossing may be 500 feet. All values in Table 1 are in seconds, with the exception of train speed, which is shown in miles per hour.

TABLE 1

| Train Speed (mph) | Time Delta | Approach Time | Programmed Time Delta | Wrap Time | Warning Time |
|---|---|---|---|---|---|
| 100 | 3.41 | 40.9 | n/a | 0 | 40.9 |
| 80 | 4.26 | 51.1 | 5 | 10 | 41.1 |
| 60 | 5.68 | 68.2 | 6 | 27 | 41.2 |
| 40 | 8.52 | 102.3 | 9 | 59 | 41.3 |

In Table 1, "Time Delta" is the calculated time necessary to traverse Approach 2 at the given train speed; "Approach Time" is the calculated time for the train to traverse Approach 1 at the given train speed; "Programmed Time Delta" is the Time Delta rounded up to the nearest whole second; "Wrap Time" is the period of time (the delay period) necessary to delay activation of the warning system after the train enters the inner approach in order to achieve the Warning Time, and "Warning Time" is the desired minimum amount of time between the time at which the grade crossing warning system 260 is activated and the time at which the train will reach the end of Approach 1.

In this embodiment, the Time Delta is rounded up to the nearest integer number of seconds to result in the Programmed Tile Delta as a safety factor, and the Programmed Time Deltas serve as the thresholds to which the time difference between the start and end inputs may be compared. In this example, the lengths of the inner approaches may be chosen to result in the desired minimum delay for a train traveling a maximum speed; as a consequence, no wrap time may be needed for a train traveling at the maximum speed. The remaining three train speeds in Table 1 (i.e., 80, 60 and 40 mph, respectively) each have an associated Programmed Time Delta. These Programmed Time Deltas may be used as thresholds to which is compared the time difference between the start and end inputs associated with an inbound train in the outer approach. Thus, if the time difference between the start and end inputs is at least 5 seconds (the Programmed Time Delta associated with 80 mph) but not more than 6 seconds (the Programmed Time Delta associated with 60 mph), the 10 second Wrap Time associated with the 80 mph train may be selected. Similarly, if the time difference between the start and end inputs is at least 6 seconds (the Programmed Time Delta associated with 60 mph) but not more than 9 seconds (the Programmed Time Delta associated with 40 mph), the 27 second Wrap Time associated with the 80 mph train may be selected. Finally, if the time difference between the start and end inputs is at least 9 seconds or more, the 59 second Wrap Time associated with the 40 mph train may be selected.

In each case in Table 1, the warning time is at least approximately 41 seconds (it will actually be longer due to the safety factor associated with rounding the Time Delta up to the Programmed Time Delta and for trains that are traveling at speeds between those of nominal speeds associated with each threshold. The latter is true because the Wrap Time is the same for trains traveling at a nominal speed of 80 mph and for trains traveling at nominal speeds below 80 mph and above 60 mph, which means that the Warning Time for the trains traveling at nominal speeds below 80 mph and above 60 mph will be longer than the warning time for the 80 mph train).

The minimum, maximum and granularity of the values and in Table 1 may be a function of the range of expected train speeds, the physical configuration of the crossing, the types of circuits and devices used to provide the start and end inputs in the outer approach, the type of track occupancy circuit used in the inner approach, and safety considerations. For example, if the components and types of circuits chosen are such that the start input energizes more quickly than the end input de-energizes or otherwise provides the end input, it may be necessary to use more coarse granularity or shorten the wrap times to account for this difference. Finer or more coarse granularities (i.e., smaller or larger numbers of thresholds, which are not necessarily fixed at integer number of seconds) may be used in other embodiments. In some embodiments, the controller may include a user interface screen, or may communicate with an external user interface screen that provides the user with the ability to select the following options for each track circuit in an inner approach: 1) a source of the start input; 2) a source of the end input (which may be the de-energization of the inner approach track itself); 3) a number of discrete delay periods used by the track circuit (i.e., the granularity of the delay period); 4) for each discrete delay period, a threshold time period corresponding to the difference between the start and end inputs (a Programmed Time Delta; and 5) for each discrete delay period, a length of the delay period (a Wrap Time).

In another embodiment, the time difference between the start and end inputs is used as an input to a mathematical formula to calculate the delay period/wrap time necessary to achieve the desired warning time. If the speed in the outer approach and the speed in the inner approach are assumed to be constant (which was assumed in Table 1 above), the delay period/wrap time for a desired warning time may be calculated according to the following formula:

$$DP=(\Delta t*(\text{outer approach length}/\text{inner approach length}))-WT$$

where DP is the wrap time or delay period in seconds, $\Delta t$ is the difference between the start and end inputs in seconds, and WT is the desired warning time in seconds. For a crossing configured as discussed above in Table 1 and a 41 second desired warning time, this equation becomes:

$$DP=(\Delta t*12)-41$$

The result of this calculation may be rounded down to the nearest integer number of seconds to result in a shorter delay period, and thus a longer warning time, for the sake of safety.

Figure 7:
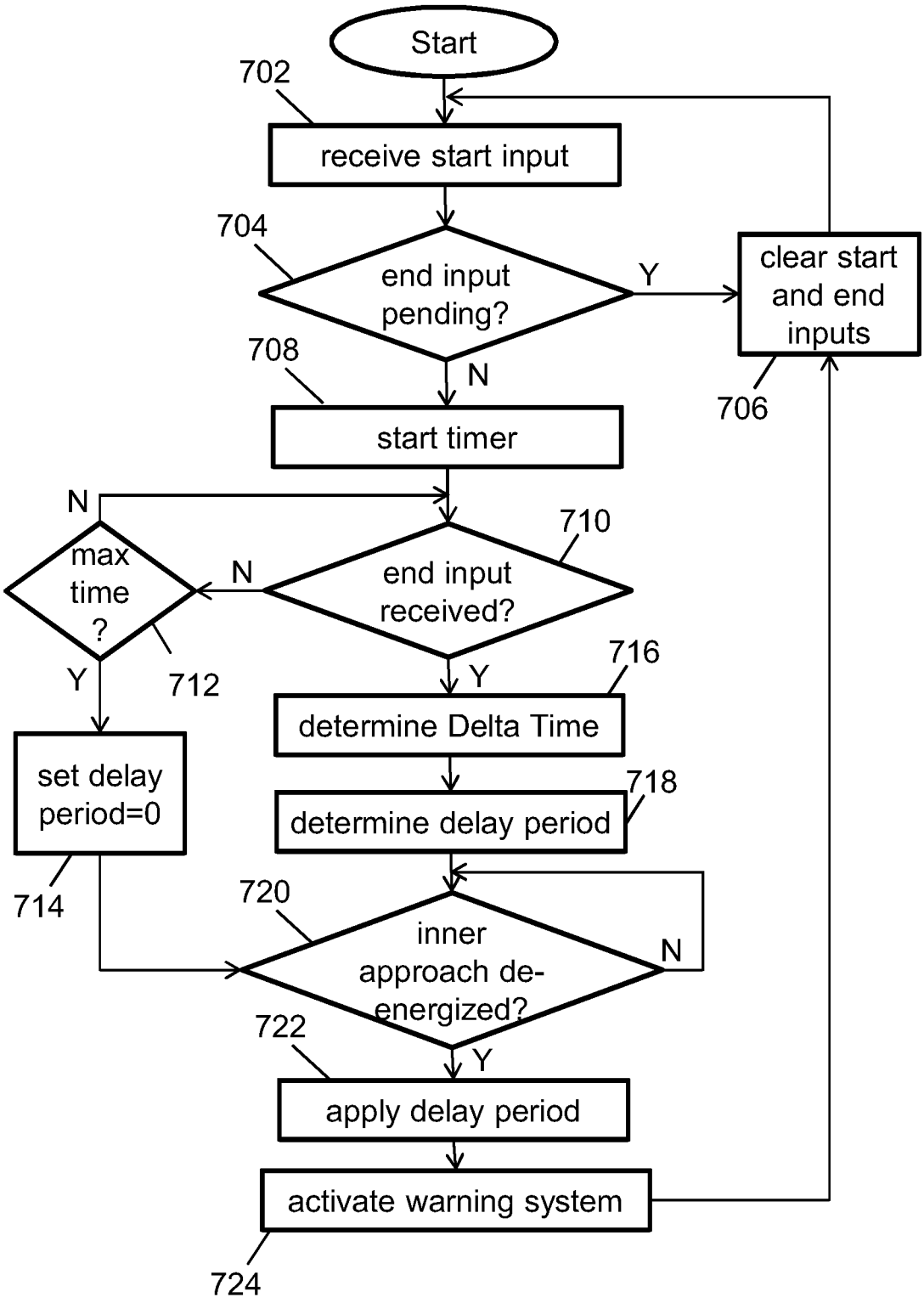
FIG. 7 is a logic diagram illustrating operations performed by a grade crossing control system according to an embodiment.

FIG. 7 is a flowchart 700 illustrating the processing that may be performed by the controller 210 according to an embodiment. The process starts when the controller 210 receives a start input at step 702. As discussed above, the start input may be received from a component such as a laser detector positioned at the start of the outer approach (which may be on either side of the crossing 200), or from a receiver forming part of a track occupancy circuit configured to monitor the outer approach (in which case de-energization of the outer approach track occupancy circuit may be the start input), or by any of the other mechanisms discussed earlier. The controller 210 may determine whether any end input is pending at step 704. As discussed above, in the event a train is outbound with respect to the crossing, an end input may occur prior to the start input. If an end input is received by the controller 210 before a start input, the end input may be stored and considered pending by the controller 210 until a start input is received. If a prior end input is pending at step 704 when the start input is received at step 702 (thus indicating an outbound train), the controller 210 may clear both the start and end inputs from memory at step 706 and the controller 210 may wait until the next start input is received at step 702. In this way, the controller 210 pairs corresponding start and end inputs from a particular train.

If no end input was pending at step 704 when the start input is received (thus indicating an inbound train), the controller may start a timer at step 708. The timer may be set to a maximum allowed time for receipt of the end input. The controller 210 may then check for receipt of an end input at step 710. The end input may be received from a component such as a laser detector positioned at the end of the outer approach, from a receiver forming part of track occupancy circuit configured to monitor the inner approach (in which case de-energization of the inner approach track circuit may be the end input), or by any of the other mechanisms discussed earlier. If the end input is not received at step 710, the controller 210 may determine whether the timer has expired at step 712. If the timer has expired at step 712, which signifies that the maximum time for receipt of the end input has been exceeded, the controller 210 may set the delay period to zero at step 714 and then may continue with step 720 as will be explained below.

If the end input is received at step 710, the controller 210 determines the Delta Time (the difference between the start and end inputs) at step 716. The controller 210 may perform this step in a number of ways. For example, the controller 210 may start a timer when the start input is received and simply read the elapsed time to determine the Time Delta. Alternatively, the controller 201 may record the time at which the start input is received at step 702 and subtract that time from the time at which the end input is received at step 710. Still other ways in which the controller 210 may determine the Time Delta will be apparent to those of skill in the art. As discussed above, the controller 210 may round (or round up) the Time Delta to an integer number of seconds as part of this step 716. The controller 210 may then determine the delay period (the Wrap Time) at step 718. As discussed above, the controller 210 may perform this step by calculating a mathematical function using the Time Delta as a parameter to determine the delay period, or may use the Time Delta as in index into a lookup table to retrieve a delay period, or may compare the calculated Time Delta to a plurality of thresholds to determine a minimum threshold exceeded by the Time Delta and then set the delay period to the a delay period associated with the minimum threshold in the manner described above. Those of skill in the art will recognize that still other schemes for determining the delay period based on the Time Delay may be performed by the controller 210.

Once the delay period has been determined at step 718 or set to zero at step 714, the controller may wait until the track circuit for the inner approach de-energizes at step 720 and then may apply the delay period at step 722 before activating the warning system 260 at step 724. The start and stop inputs may then be cleared at step 706 and the process may be repeated starting at step 702. It should be noted that other steps not illustrated in FIG. 7 (e.g., setting the stick timer so that the track occupancy circuit on the opposite side of the island does not prevent deactivation of the warning system 260) may be performed in addition to the steps shown in FIG. 7.

The controller circuit disclosed herein can be implemented in digital electronic circuitry, or in computer software, firmware, hardware, or in combinations of one or more of them. The logical operations described herein can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more them. The term "data processing apparatus" encompasses all apparatus, devices, and machines for processing data, including by way of example a programmable processor (including, but not limited to microprocessors and microcontrollers), a computer, multiple processors or computers, or special purpose logic circuitry. The data processing apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, which is generated to encode information for transmission to suitable receiver apparatus.

A computer program (also known as a program, software, software application, script, or code) can be written in any programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic operations described in this document can be performed by one or more programmable processors executing one or more computer programs to perform functions by operating on input data and generating output. Processors suitable for the execution of a computer program include, by way of example, both general and special purpose microprocessors and microcontrollers, digital signal processors, and any one or more processors of any kind of digital computer. The processes and logic flows can also be performed by, and apparatus can also be implemented as, special purpose logic circuitry, e.g., an FPGA (field programmable gate array) or an ASIC (application specific integrated circuit). Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

The invention claimed is:

1. A method for controlling a grade crossing warning system, the method comprising:

receiving by a control circuit a first input indicating that a train has reached a point at a start of an outer approach;

receiving by the control circuit a second input indicating that a train has reached a point at an end of an outer approach, the second input received after the first input;

determining by the control circuit a time difference between the first input and the second input;

determining by the control circuit a delay period to delay activation of the grade crossing warning system, an amount of the delay period being based on the time difference;

receiving by the control circuit a third input from a track occupancy circuit configured to detect a presence of the train in an inner approach; and delaying by the control circuit activation of the grade crossing warning system by the delay period following receipt of the third input.

2. The method of claim 1, wherein the first input is received from a track occupancy circuit configured to detect a presence of a train in the outer approach, the first input indicating that a train is present in the outer approach.

3. The method of claim 1, wherein the second input is received from the track occupancy circuit configured to detect a presence of a train in the outer approach, the second input indicating that a train is not present in the outer approach.

4. The method of claim 1, wherein the second input is received from a track occupancy circuit configured to detect a presence of a train in the inner approach, the second input indicating that the train is present in the inner approach.

5. The method of claim 1, wherein the first input is received from a track circuit configured to detect the presence of a train anywhere in the outer or the inner approach, the first input indicating that a train is present in the outer or inner approach.

6. The method of claim 1, wherein the delay period is determined using the time difference as an index to a lookup table.

7. The method of claim 1, wherein the delay period is determined by calculating a function using the time difference as a parameter.

8. The method of claim 1, wherein the delay period is determined by comparing the time difference to a plurality of thresholds to identify a minimum threshold reached by the time difference and selecting the delay period associated with the minimum threshold.

9. A control circuit for controlling a grade crossing warning system, the grade controller comprising:

a processor;

an interface; and a memory;

wherein the processor is configured to receive a first input indicating that a train has reached a point at a start of an outer approach;

receive a second input indicating that a train has reached a point at an end of an outer approach, the second input received after the first input;

determine a time difference between the first input and the second input;

determine a delay period to delay activation of the grade crossing warning system, an amount of the delay period being based on the time difference;

receive a third input from a first track occupancy circuit configured to detect a presence of the train in an inner approach; and delay activation of the grade crossing warning system by the delay period following receipt of the third input.

10. The control circuit of claim 9, further comprising a timer connected to the processor, wherein the processor is configured to determine the time difference using the timer.

11. The control circuit of claim 9, wherein the processor is configured to determine the time difference by storing a time when the first input is received in a memory and calculating the difference between the time stored in the memory and the time at which the second input is received.

12. The control circuit of claim 9, wherein the first track occupancy circuit is an alternating current track circuit.

13. The control circuit of claim 9, wherein the first track occupancy circuit is an alternating current overlay track circuit.

14. The control circuit of claim 13, wherein the first track occupancy circuit comprises a receiver and a transmitter, and wherein the transmitter is connected to receive a signal from a second track occupancy circuit configured to detect a presence of the train in the outer approach, and to transmit a first code if the signal from the second track occupancy circuit indicates that a train is present in the outer approach and to transmit a second code if the signal from the second track occupancy circuit indicates that a train is not present in the outer approach.

15. The control circuit of claim 9, wherein the second track occupancy circuit is an alternating current overlay track occupancy circuit configured to detect a presence of the train in the outer approach.

16. The control circuit of claim 14, wherein the controller is configured to receive the first input from a second track occupancy circuit, the first input indicating that a train is present in the outer approach.

17. The control circuit of claim 16, wherein the controller is configured to receive the second input from the first track occupancy circuit, the second input indicating that a train is present in the inner approach.

* * * * *